US008022792B2

(12) United States Patent
Howard

(10) Patent No.: US 8,022,792 B2
(45) Date of Patent: Sep. 20, 2011

(54) TM MODE EVANESCENT WAVEGUIDE FILTER

(76) Inventor: John Howard, Upper Mount Bethal, PA (US)

( * ) Notice: Subject to any disclaimer, the term of this patent is extended or adjusted under 35 U.S.C. 154(b) by 426 days.

(21) Appl. No.: 12/201,525

(22) Filed: Aug. 29, 2008

(65) Prior Publication Data

US 2009/0058564 A1 Mar. 5, 2009

Related U.S. Application Data

(60) Provisional application No. 60/967,168, filed on Aug. 31, 2007.

(51) Int. Cl.
*H01P 1/208* (2006.01)

(52) U.S. Cl. ..... 333/210; 333/212

(58) Field of Classification Search ..... 333/202, 333/208–212, 227–233
See application file for complete search history.

(56) References Cited

U.S. PATENT DOCUMENTS 3,634,788 A 1/1972 Craven
4,673,903 A 6/1987 Saad
4,837,535 A * 6/1989 Konishi et al. ..... 333/210
6,055,420 A 4/2000 Veranth
7,123,200 B1 10/2006 Smith et al.
2004/0239452 A1 12/2004 Bassali
2006/0185161 A1 8/2006 Rauscher
2006/0186969 A1 8/2006 Rauscher
2007/0069741 A1 3/2007 Kleismit et al.
2007/0170930 A1 7/2007 Bassali et al.

* cited by examiner

*Primary Examiner* — Benny Lee
*Assistant Examiner* — Gerald Stevens
(74) *Attorney, Agent, or Firm* — Hoffmann & Baron, LLP

(57) ABSTRACT

Waveguide filters utilizing the TM modes in an evanescent waveguide are provided. The Q of such filters surpasses any evanescent, dual and triple mode filters in propagating or evanescent waveguides. The waveguide filter in accordance with the present invention features a small size, as well as ease and simplicity in its manufacture when compared with conventional filters. Filters of exceptionally high Q and very low loss, when compared to conventional filters, can be obtained by employing TM modes in an evanescent waveguide. The TM mode evanescent filter has a higher Q than either the evanescent TE mode standard filter of a single mode propagating waveguide (TM or TE) or even the dual or triple mode filters in evanescent or propagating waveguides.

4 Claims, 4 Drawing Sheets

TM MODE EVANESCENT WAVEGUIDE FILTER

CROSS-REFERENCE TO RELATED APPLICATION

This application claims priority based on U.S. Provisional Application Ser. No. 60/967,168 filed on Aug. 31, 2007, which is incorporated herein by reference in its entirety.

BACKGROUND OF THE INVENTION

1. Field of the Invention

The present invention generally relates to waveguide filters, and more particularly to utilizing electric (E) field or TM modes in evanescent waveguides.

2. Brief Discussion of the Related Art

Radio transmitters and receivers require filters to remove or suppress unwanted frequencies from being transmitting or received. The transmitter portion of a radio may generate frequencies that will interfere with the radio system, or that may be prohibited by a radio frequency spectrum governing body. The receiver may need to suppress unwanted signals at different frequencies generated by the transmitter, or received from an external source, which would adversely affect the performance of the receiver.

At millimeter-wave frequencies sources of unwanted frequencies include the local oscillator frequency, image frequencies from the mixer, and the transmitter frequencies (in the case of the receiver). The frequencies generated by the mixer and the local oscillator are functions of the selected radio architecture. The closer the oscillator frequency (or its harmonics) is to the transmitter frequencies, the more difficult it is to remove the undesired frequency. However, wider spaced frequencies may result in more complex circuitry resulting in a more expensive radio implementation. A small separation between the transmit and receive frequencies can result in unwanted high power transmit frequencies leaking into the receiver. The separation between the transmit and receive frequencies is usually specified by the licensing bodies and the system operators. The radio designer may not have control over this specification.

To suppress unwanted frequencies below an acceptable power level, a filter element is required in the signal path. The filter element discriminates between the desired and undesired frequencies based on the wavelengths of the signals. At millimeter-wave frequencies the difference between the wavelengths is very small, resulting in very high manufacturing tolerances.

SUMMARY OF THE INVENTION

In conventional waveguide filters, the dominant H10 mode is usually present. The electric field modes, or TM modes, are usually avoided since designs using TM modes become more cumbersome and the filters become less stable or reliable without any apparent advantage. However, in below cutoff waveguides, utilization of the electric (E) field advantageously introduces very high Q's in very small and thus lightweight filters.

The present invention relates to waveguide filters utilizing the TM modes in an evanescent waveguide. The Q of such filters surpasses any evanescent, dual and triple mode filters in propagating or evanescent waveguides. The waveguide filter in accordance with the present invention features a small size, as well as ease and simplicity in its manufacture when compared with the above-mentioned conventional filters.

Filters of exceptionally high Q and very low loss, when compared to all other filters in existence today, can be obtained by employing TM modes in an evanescent waveguide. The TM mode evanescent filter has a higher Q than either the evanescent TE mode standard filter of a single mode propagating waveguide (TM or TE) or even the dual or triple mode filters in evanescent or propagating waveguides.

In accordance with one aspect of the present invention, a waveguide filter is provided which includes at least one evanescent waveguide section, and at least one propagating dielectric filled waveguide section coupled to the at least one evanescent waveguide section. The waveguide filter utilizes at least one TM mode.

The at least one evanescent waveguide section may be defined using the following equations:

$$Y_{e|i} = -\frac{1}{jX_0}\coth\gamma_e l_{e|i} \tag{1}$$

$$\sinh(\gamma_e l_{e|i}) = -\frac{\Delta\omega_0}{\omega_2-\omega_1}\sqrt{\frac{g_i g_{i+1}}{\omega_0 C_i \omega_0 C_{i+1}}} \tag{2}$$

$$\omega_0 C_i = \coth\gamma_e l_{e|i-1} + \coth\gamma_e l_{e|i} = Y_{e|i-1} + Y_{e|i} \text{ normalized} \tag{3}$$

where $Y_{e|i}$ is a resultant admittance of a capacitor associated with a J inverter in the evanescent waveguide, $l_e$ is a length of the evanescent sections, $\gamma_e$ is a propagation constant inside the evanescent waveguide, $\omega_0$ is associated with a center frequency of the filter, $\omega_1$ and $\omega_2$ are associated with a lower and upper passband edges, respectively, $g_i$ are low-pass prototype values, and $\Delta$ is a correction factor for the TM modes, which corrects the steeper frequency response of the evanescent cut-off compared to lumped elements and is given by:

$$\Delta = \frac{2}{1+\frac{1}{1-\left(\frac{\lambda_c}{\lambda_0}\right)^2}} \tag{4}$$

where $\lambda_c$ is a cutoff wavelength and $\lambda_0$ is a wavelength at the center frequency.

The at least one propagating dielectric filled waveguide section may be defined using the following equations:

$$\beta_p l_{p|i} = \pi - \phi_i - \phi_{i-1} \tag{5}$$

$$\varphi_i = \tan^{-1}\left(\frac{Z_{0|e}}{jZ_{0|p}}\cdot\tanh(\gamma_e l_{e|i})\right) \tag{6}$$

where $\beta_p$ is a propagation constant in the propagating dielectric-filled waveguide, $l_p$ is a length of each propagating section, $Z_{0|e}$ is a characteristic impedance of the evanescent waveguide, which is imaginary in nature, $Z_{0|p}$ is a characteristic impedance of the propagating dielectric-filled waveguide, which is real in nature, and $\phi_i$ is a phase associated with the admittance $Y_{e|i}$.

Other objects and features of the present invention will become apparent from the following detailed description considered in conjunction with the accompanying drawings. It is to be understood, however, that the drawings are designed as an illustration only and not as a definition of the limits of the invention.

DETAILED DESCRIPTION OF THE PREFERRED EMBODIMENTS

Figure 1:
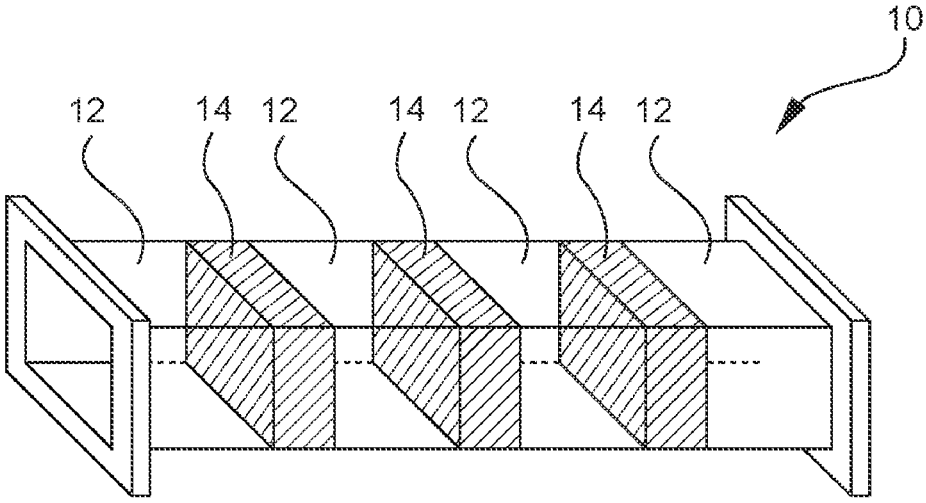
FIG. 1 shows the structure of an evanescent waveguide filter utilizing dielectric sections in accordance with the present invention.

A waveguide filter 10 formed in accordance with the present invention is shown in FIG. 1. The waveguide filter 10 includes at least one evanescent waveguide section 12 and at least one propagating dielectric filled waveguide section 14 coupled to the at least one evanescent waveguide section. The waveguide filter utilizes at least one TM mode.

In conventional waveguide filters, the dominant H10 mode is usually present. The electric field modes, or TM modes, are usually avoided since designs using TM modes become more cumbersome and the filters become less stable or reliable without any apparent advantage. However, in below cutoff waveguides, utilization of the electric (E) field advantageously introduces very high Q's in very small and thus lightweight filters.

The present invention relates to waveguide filters utilizing the TM modes in an evanescent waveguide. The Q of such filters surpasses any evanescent, dual and triple mode filters in propagating or evanescent waveguides. The waveguide filter in accordance with the present invention features a small size, as well as ease and simplicity in its manufacture when compared with the above-mentioned conventional filters.

Figure 5A:
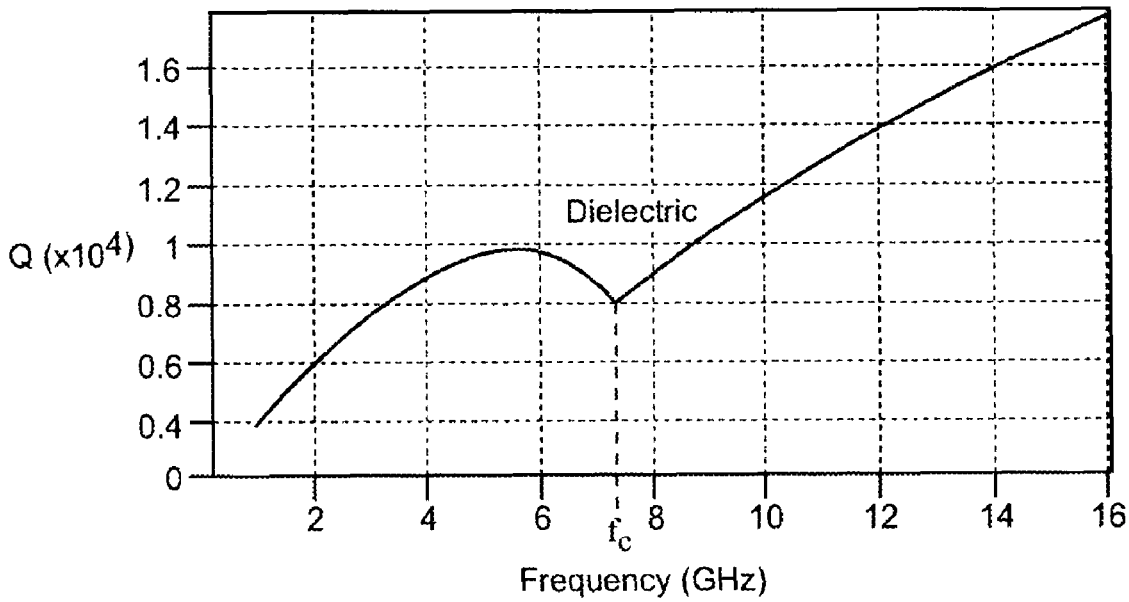
FIG. 5A shows the Q factor of an evanescent waveguide operating in the TE mode.
Figure 5B:
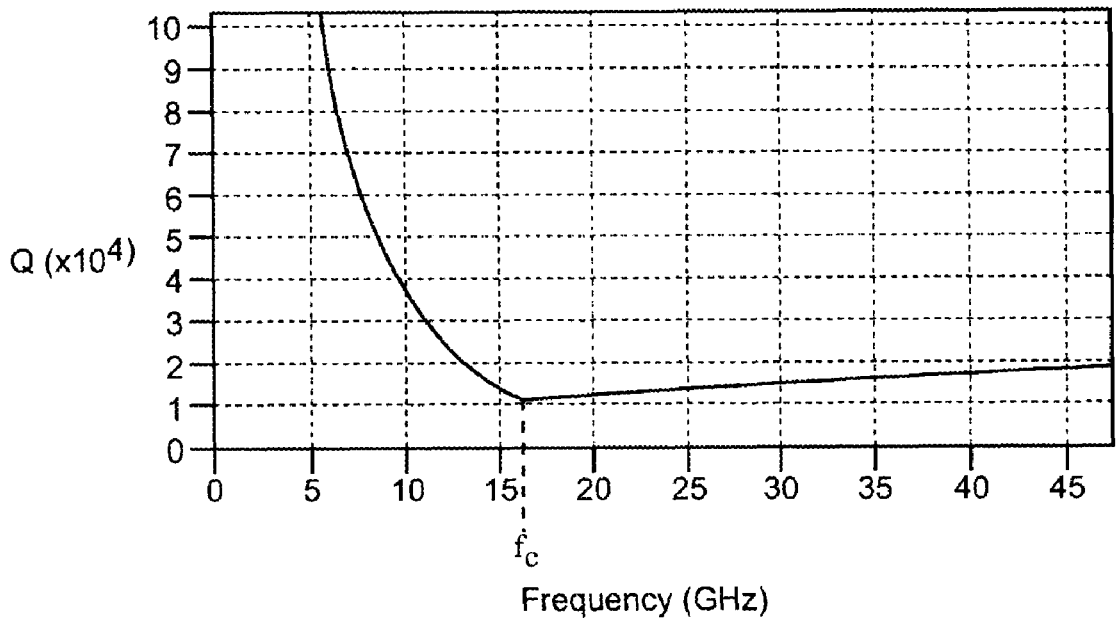
FIG. 5B shows the Q factor of an evanescent waveguide operating in the TM mode.

Filters of exceptionally high Q and very low loss, when compared to all other filters in existence today, can be obtained by employing TM modes in an evanescent waveguide. The TM mode evanescent filter has a higher Q than either the evanescent TE mode standard filter of a single mode propagating waveguide (TM or TE) or even the dual or triple mode filters in evanescent or propagating waveguides. FIGS. 5A and 5B show a comparison of the Q of waveguides below and above cutoff for the TE and TM modes.

Evanescent TM waveguide filters can be analyzed using transmission line theory. FIGS. 5A and 5B provide a theoretical comparison between the TE evanescent waveguide filter as described in further detail in G. F. Craven and C. K. Mok, "The Design of Evanescent Mode Waveguide Bandpass Filters for a Prescribed Insertion Loss Characteristic", IEEE Transactions on Microwave Theory and Techniques, Vol. MTT-19, No. 3, March 1971; Dr. John Howard and Wenny Lin, "Evanescent Mode Filter: Design and Implementation" Microwave Journal, October 1989; and Dr. J. Howard and M. Lavey, "Simplified method eases the design of bandpass filters", Microwaves and RF, December 2000, which are incorporated herein by reference. The TM evanescent waveguide filter presented on this invention, for a very narrow bandwidth of 0.1%. As seen from the analysis the Q of the TM mode evanescent filter is greater than the Q of the TE mode evanescent filter.

The design of the TM evanescent waveguide filter in accordance with the present invention will now be discussed. An evanescent waveguide section in the TM field can be modeled as a Π network as shown in FIG. 2A, or a T network as shown in FIG. 2B.

Figure 2A:
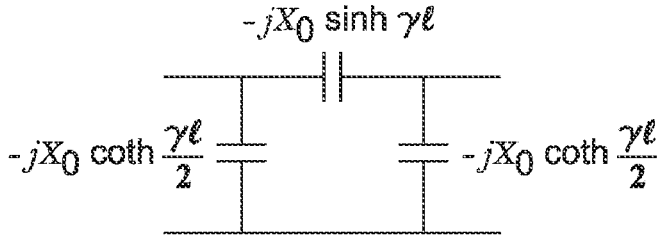
FIG. 2A shows an evanescent waveguide section in the TM field modeled as a Π network.
Figure 2B:
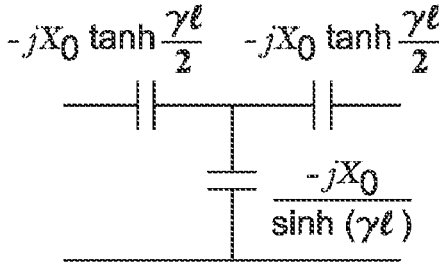
FIG. 2B shows an evanescent waveguide section in the TM field modeled as a T network.
Figure 3:
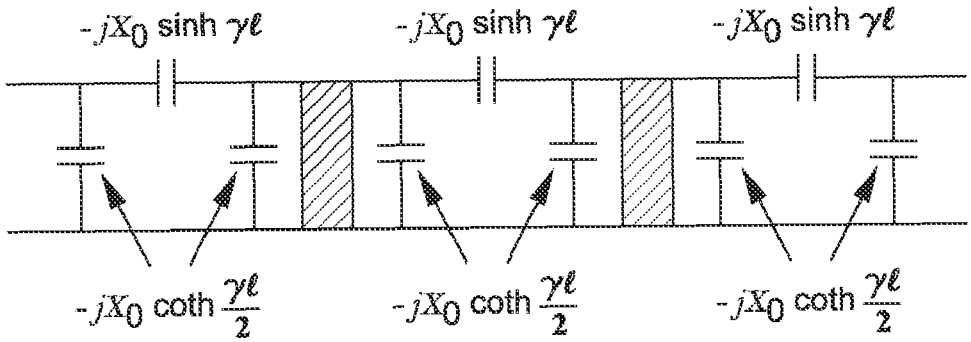
FIG. 3 shows a model of the waveguide filter in accordance with the present invention employing the Π network of FIG. 2A. An equivalent model using the Π network with J-inverters is shown in FIG. 4.
Figure 4:
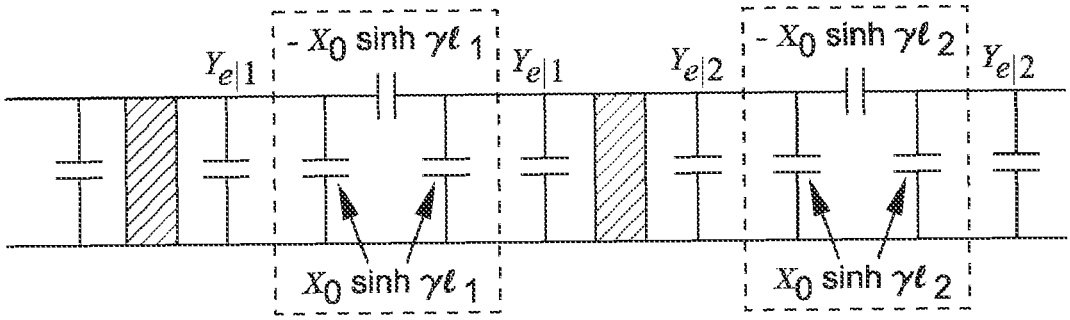
FIG. 4 shows a model of the waveguide filter in accordance with the present invention employing the Π network of FIG. 2A with J-inverters.

Employing the Π network of FIG. 2A, sections of high Q dielectric, are added in order to form the filter shown in FIG. 3. This process is described in further detail in N. McN. Alford, S. J. Penn, A. Templeton, X. Wang, J. C. Gallop, N. Klein, C. Zuccaro and P. Filhol, "Microwave Dielectrics", IEEE Colloquium on Electro-technical Ceramics—Processing, Properties and Applications (Ref. No: 1997/317), November 1997, which is incorporated herein by reference. An equivalent model using the Π network with J-invertors for more straightforward calculations is shown in FIG. 4.

The equations associated with the above structure are as follows:

$$Y_{e|i} = -\frac{1}{jX_0}\coth\gamma_e l_{e|i} \tag{1}$$

$$\sinh(\gamma_e l_{e|i}) = -\frac{\Delta\omega_0}{\omega_2-\omega_1}\sqrt{\frac{g_i g_{i+1}}{\omega_0 C_i \omega_0 C_{i+1}}} \tag{2}$$

$$\omega_{)}C_i = \coth\gamma_e l_{e|i-1} + \coth\gamma_e l_{e|i} = Y_{e|i-1} + Y_{e|i} \text{ normalized} \tag{3}$$

where $Y_{e|i}$ is the resultant admittance of the capacitor associated with the J inverter in the evanescent waveguide, $l_e$ is the length of the evanescent sections, $\gamma_e$ is the propagation constant inside the evanescent waveguide, $\omega_0$ is associated with the center frequency of the filter, $\omega_1$ and $\omega_2$ are associated with the lower and upper passband edges, respectively, $g_i$ are the low pass prototype values, and Δ is the correction factor for the TM modes, which corrects the steeper frequency response of the evanescent cut-off compared to lumped elements and is given by:

$$\Delta = \frac{2}{1+\frac{1}{1-\left(\frac{\lambda_c}{\lambda_0}\right)^2}} \tag{4}$$

where $\lambda_c$ is the cutoff wavelength and $\lambda_0$ the wavelength at the center frequency. In between the evanescent sections, there are propagating dielectric filled waveguide sections. The equations associated with the resonance of the propagating sections are as follows:

$$\beta_p l_{p|i} = \pi - \varphi_i - \varphi_{i-1} \tag{5}$$

$$\varphi_i = \tan^{-1}\left(\frac{Z_{0|e}}{jZ_{0|p}}\cdot\tanh(\gamma_e l_{e|i})\right) \tag{6}$$

where $\beta_p$ is the propagation constant in the propagating dielectric-filled waveguide and $l_p$ is the length of each propagating section, $Z_{0|e}$ is the characteristic impedance of the evanescent waveguide, which is imaginary in nature, $Z_{0|p}$ is the characteristic impedance of the propagating dielectric-filled waveguide which is real in nature, and $\phi_i$ is the phase associated with the admittance $Y_{e|i}$.

An example will now be discussed. To design a bandpass Chebyshev filter with a passband between 3.998 and 4.002 GHz, a ripple of 0.1 dB, a stopband between 3.09 and 4.01, and an attenuation of 100 dB, the corresponding low-pass prototype values are as follows:

$g_0=1$;
$g_1=0.7970$;
$g_2=1.3924$;
$g_3=1.7481$;
$g_4=1.6331$;
$g_5=1.7481$;
$g_6=1.3924$;
$g_7=0.7970$; and
$g_8=1$.

The selected waveguide is WR90 with internal dimensions of 0.9 in by 0.4 in. The dielectric chosen is Ba(Mg1/3 Ta2/3) O3. Although this dielectric material does not have the highest Q, its dielectric constant of 24 suits this design. The Q of this material is 65,000 at 4 GHz, as described in further detail in N. McN. Alford, S. J. Penn, A. Templeton, X. Wang, J. C. Gallop, N. Klein, C. Zuccaro and P. Filhol, "Microwave Dielectrics", IEEE Colloquium on Electro-technical Ceramics Processing, Properties and Applications (Ref. No: 1997/317), November 1997. The Q of the evanescent waveguide at 4 GHz is over 176,000, which is shown in FIG. 5B.

Using the above lowpass prototype values and by iterating equations (1) to (3) above, the evanescent lengths are found as follows:

$l_0=1.1811$;
$l_1=0.8320$;
$l_2=0.8791$;
$l_3=0.8887$;
$l_4=0.8887$;
$l_5=0.8791$;
$l_6=0.8320$; and
$l_7=1.1811$.

The first and last lengths are arbitrary, but long enough to provide the desired attenuation. The propagating lengths in the dielectric are calculated using equations (5) and (6) as follows:

$l_{p0}=1.0141$;
$l_{p1}=1.0141$;
$l_{p2}=1.0141$;
$l_{p3}=1.0141$;
$l_{p4}=1.0141$;
$l_{p5}=1.0141$; and
$l_{p6}=1.0141$.

Figure 6A:
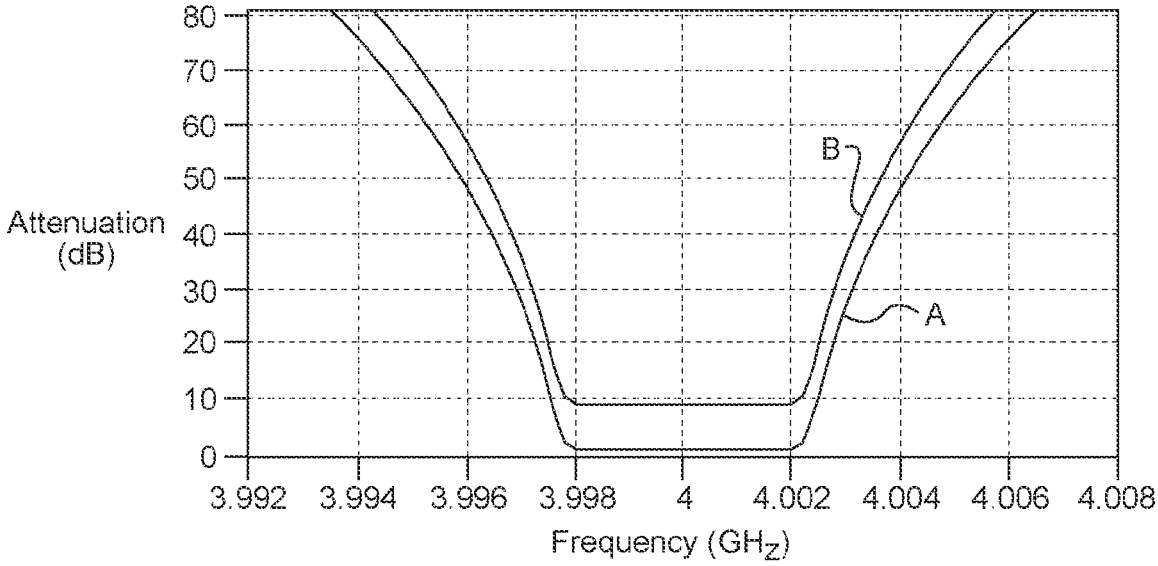
FIGS. 6A and 6B show a comparison in frequency responses between TE and TM evanescent waveguide filter structures.
Figure 6B:
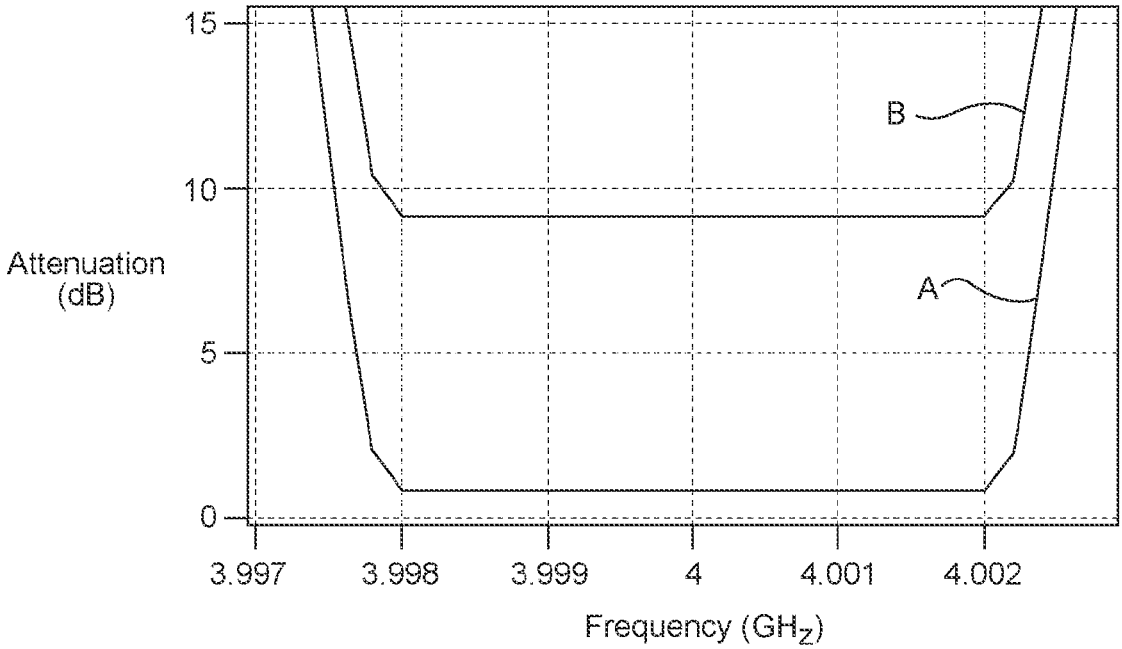

The performance of this filter is shown by curve A in FIGS. 6A and 6B and compared with a standard evanescent waveguide filter (TE mode) shown by curve B. FIG. 6*b* is an exploded view of the lower portion of FIG. 6A.

Although the example refers to a bandpass filter in a rectangular waveguide, it is also intended to be within the scope of the present invention to be able to implement highpass, lowpass, and bandstop filters with various cross-sectional shapes, such as, but not limited to circular, square and other shapes known in the art using the equations defined above.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. A waveguide filter comprising:

at least one evanescent waveguide section; and at least one propagating dielectric filled waveguide section coupled to the at least one evanescent waveguide section, the waveguide filter utilizing at least one TM mode, the at least one evanescent waveguide section being defined using the following equations:

$$Y_{e|i} = -\frac{1}{jX_0}\coth\gamma_e l_{e|i} \tag{1}$$

$$\sinh(\gamma_e l_{e|i}) = -\frac{\Delta\omega_0}{\omega_2-\omega_1}\sqrt{\frac{g_i g_{i+1}}{\omega_0 C_i \omega_0 C_{i+1}}} \tag{2}$$

$$\omega_0 C_i = \coth\gamma_e l_{e|i-1} + \coth\gamma_e l_{e|i} = Y_{e|i-1} + Y_{e|i} \text{ normalized} \tag{3}$$

where $Y_{e|i}$ is a resultant admittance of a capacitor associated with a J inverter in the evanescent waveguide, $l_e$ is a length of the evanescent sections, $\gamma_e$ is a propagation constant inside the evanescent waveguide, $\omega_0$ is associated with a center frequency of the filter, $\omega_1$ and $\omega_2$ are associated with a lower and upper passband edges, respectively, $g_i$ are low-pass prototype values, and $\Delta$ is a correction factor for the at least one TM mode, which corrects the steeper frequency response of the evanescent cut-off compared to lumped elements and is given by:

$$\Delta = \frac{2}{1+\frac{1}{1-\left(\frac{\lambda_c}{\lambda_0}\right)^2}} \tag{4}$$

where $\lambda_c$ is a cutoff wavelength and $\lambda_0$ is a wavelength at the center frequency.

2. A waveguide filter comprising:

at least one evanescent waveguide section; and at least one propagating dielectric filled waveguide section coupled to the at least one evanescent waveguide section, the waveguide filter utilizing at least one TM mode, the at least one propagating dielectric filled waveguide section being defined using the following equations:

$$\beta_p l_{p|i} = \pi - \phi_i - \phi_{i+1} \tag{5}$$

$$\varphi_i = \tan^{-1}\left(\frac{Z_{0|e}}{jZ_{0|p}}\cdot\tanh(\gamma_e l_{e|i})\right) \tag{6}$$

where $\beta_p$ is a propagation constant in the propagating dielectric-filled waveguide, $l_p$ is a length of each propagating section, $Z_{0|e}$ is a characteristic impedance of the evanescent waveguide, which is imaginary in nature, $Z_{0|p}$ is a characteristic impedance of the propagating dielectric-filled waveguide, which is real in nature, and $\phi_i$ is a phase associated with the admittance $\gamma_{e|i}$.

3. A method of filtering using a waveguide comprising:

coupling at least one evanescent waveguide section to at least one propagating dielectric filled waveguide section; and the waveguide filter utilizing at least one TM mode, the at least one evanescent waveguide section being defined using the following equations:

$$Y_{e|i} = -\frac{1}{jX_0}\coth\gamma_e l_{e|i} \tag{1}$$

$$\sinh(\gamma_e l_{e|i}) = -\frac{\Delta\omega_0}{\omega_2 - \omega_1}\sqrt{\frac{g_i g_{i+1}}{\omega_0 C_i \omega_0 C_{i+1}}} \tag{2}$$

$$\omega_0 C_i = \coth\gamma_e l_{e|i-1} + \coth\gamma_e l_{e|i} = Y_{e|i-1} + Y_{e|i} \text{ normalized} \tag{3}$$

where $Y_{e|i}$ is a resultant admittance of a capacitor associated with a J inverter in the evanescent waveguide, $l_e$ is a length of the evanescent sections, $\gamma_e$ is a propagation constant inside the evanescent waveguide, $\omega_0$ is associated with a center frequency of the filter, $\omega_1$ and $\omega_2$ are associated with a lower and upper passband edges, respectively, $g_i$ are low-pass prototype values, and $\Delta$ is a correction factor for the TM modes, which corrects the steeper frequency response of the evanescent cut-off compared to lumped elements and is given by:

$$\Delta = \frac{2}{1 + \frac{1}{1 - \left(\frac{\lambda_c}{\lambda_0}\right)^2}} \tag{4}$$

where $\lambda_c$ is a cutoff wavelength and $\lambda_0$ is a wavelength at the center frequency.

4. A method of filtering using a waveguide comprising:

coupling at least one evanescent waveguide section to at least one propagating dielectric filled waveguide section; and the waveguide filter utilizing at least one TM mode, the at least one propagating dielectric filled waveguide section being defined using the following equations:

$$\beta_p l_{p|i} = \pi - \phi_i - \phi_{i+1} \tag{5}$$

$$\varphi_i = \tan^{-1}\left(\frac{Z_{0|e}}{jZ_{0|p}} \cdot \tanh(\gamma_e l_{e|i})\right) \tag{6}$$

where $\beta_p$ is a propagation constant in the propagating dielectric-filled waveguide, $l_p$ is a length of each propagating section, $Z_{0|e}$ is a characteristic impedance of the evanescent waveguide, which is imaginary in nature, $Z_{0|p}$ is a characteristic impedance of the propagating dielectric-filled waveguide, which is real in nature, and $\phi_i$ is a phase associated with the admittance $\gamma_{e|i}$.

* * * * *

UNITED STATES PATENT AND TRADEMARK OFFICE

CERTIFICATE OF CORRECTION

PATENT NO. : 8,022,792 B2
APPLICATION NO. : 12/201525
DATED : September 20, 2011
INVENTOR(S) : John Howard It is certified that error appears in the above-identified patent and that said Letters Patent is hereby corrected as shown below:

IN THE PATENT:

Column 2, line 48:

Now reads: "$\beta_p l_{p\backslash i} = \pi - \varphi_i - \varphi_{i-1}$"

Should read: -- $\beta_p l_{p\backslash i} = \pi - \varphi_i - \varphi_{i+1}$ --

Column 4, line 35:

Now reads: "$\omega_) C_1 = \coth \gamma_e l_{e\backslash i-1} + \coth \gamma_e l_{e\backslash i} = Y_{e\backslash i-1} + Y_{e\backslash i}$ normalized"

Should read: -- $\omega_0 C_1 = \coth \gamma_e l_{e\backslash i-1} + \coth \gamma_e l_{e\backslash i} = Y_{e\backslash i-1} + Y_{e\backslash i}$ normalized --

Column 4, line 59:

Now reads: "$\beta_p l_{p\backslash i} = \pi - \varphi_i - \varphi_{i-1}$"

Should read: -- $\beta_p l_{p\backslash i} = \pi - \varphi_i - \varphi_{i+1}$ --

Signed and Sealed this
Sixth Day of November, 2012

David J. Kappos

David J. Kappos
*Director of the United States Patent and Trademark Office*